US010675504B2

(12) United States Patent
Chang et al.

(10) Patent No.: US 10,675,504 B2
(45) Date of Patent: Jun. 9, 2020

(54) LATERAL GLIDE ELLIPTICAL EXERCISE APPARATUS

(71) Applicant: Rexon Industrial Corp., Ltd., Taichung (TW)

(72) Inventors: Yao-Jen Chang, Taichung (TW); Chen-Fei Yang, Taichung (TW)

(73) Assignee: REXON INDUSTRIAL CORP., LTD., Taichung (TW)

( * ) Notice: Subject to any disclaimer, the term of this patent is extended or adjusted under 35 U.S.C. 154(b) by 339 days.

(21) Appl. No.: 15/465,735

(22) Filed: Mar. 22, 2017

(65) Prior Publication Data

US 2017/0274244 A1 Sep. 28, 2017

(30) Foreign Application Priority Data

Mar. 22, 2016 (TW) ..... 105108777 A

(51) Int. Cl.

| | |
|---|---|
| ***A63B 22/00*** | (2006.01) |
| ***A63B 24/00*** | (2006.01) |
| ***A63B 21/22*** | (2006.01) |
| ***A63B 22/06*** | (2006.01) |

(Continued)

(52) U.S. Cl.

CPC ..... *A63B 22/0664* (2013.01); *A63B 21/005* (2013.01); *A63B 22/001* (2013.01); *A63B 22/0015* (2013.01); *A63B 21/00072* (2013.01); *A63B 21/225* (2013.01); *A63B 24/0087* (2013.01); *A63B 2022/0028* (2013.01); *A63B 2022/0074* (2013.01); *A63B 2022/0682* (2013.01)

(58) Field of Classification Search

CPC ..... A63B 22/0664; A63B 2022/0676; A63B 2022/0688; A63B 22/20; A63B 22/201; A63B 22/203; A63B 2022/206; A63B 22/208; A63B 21/4034; A63B 21/4035; A63B 21/22; A63B 21/0608; A63B 21/225; A63B 22/0015; A63B 22/0061; A63B 2022/0074; A63B 69/0022; A63B 2244/18; A63B 69/18; A63B 69/182; A63B 23/0417; A63B 244/19; A63B 23/0423

See application file for complete search history.

(56) References Cited

U.S. PATENT DOCUMENTS 4,186,920 A * 2/1980 Fiore ..... A63B 22/18 403/138

6,672,992 B1 * 1/2004 Lo ..... A63B 22/0015 482/52

(Continued)

*Primary Examiner* — Sundhara M Ganesan
*Assistant Examiner* — Shila Jalalzadeh Abyaneh
(74) *Attorney, Agent, or Firm* — Bacon & Thomas, PLLC

(57) ABSTRACT

A lateral glide elliptical exercise apparatus includes a frame defining a center line, a pair of pedal units disposed at two opposite lateral sides relative to the center line each including a pivoting block and a pedal shaft pivotally connected to the pivoting block, a damping unit for providing a damping resistance to the pedal units, and a pair of gliding guide units respectively mounted at the frame, each gliding guide unit includes a gliding guide, an actuation block and a linkage arranged so that the actuation block can be driven by the associating linkage to slide smoothly between an inner end portion and an outer end portion of the associating gliding guide when the pedal units are being alternately pedaled by the user.

9 Claims, 14 Drawing Sheets

(51) Int. Cl.
*A63B 21/005* (2006.01)
*A63B 21/00* (2006.01)

(56) References Cited

U.S. PATENT DOCUMENTS 6,849,032 B2 * 2/2005 Chu ..... A63B 22/001 482/51
7,425,189 B1 * 9/2008 Eschenbach ..... A63B 22/001 482/51
7,591,762 B2 * 9/2009 Chang ..... A63B 22/001 482/52
7,682,293 B2 * 3/2010 Eschenbach ..... A63B 21/015 482/51
8,852,059 B1 * 10/2014 Stearns ..... A63B 22/001 482/52
9,364,707 B2 * 6/2016 Grossmann ..... A63B 21/4047
2003/0216222 A1 * 11/2003 Kuo ..... A63B 22/0056 482/52
2006/0046902 A1 * 3/2006 Chang ..... A63B 22/0664 482/52
2007/0219063 A1 * 9/2007 Anderson ..... A63B 21/154 482/52
2008/0312044 A1 * 12/2008 Chen ..... A63B 22/0064 482/52
2009/0111663 A1 * 4/2009 Kuo ..... A63B 22/001 482/53
2009/0291810 A1 * 11/2009 Kwon ..... A63B 22/001 482/52
2011/0105280 A1 * 5/2011 Jhang ..... A63B 22/0015 482/52
2012/0004077 A1 * 1/2012 Chu ..... A63B 21/225 482/52
2014/0194253 A1 * 7/2014 Huang ..... A63B 22/001 482/52
2014/0194254 A1 * 7/2014 Huang ..... A63B 22/04 482/52
2016/0361588 A1 * 12/2016 Kuo ..... A63B 22/0015
2017/0036062 A1 * 2/2017 Huang ..... A63B 71/0622

* cited by examiner

LATERAL GLIDE ELLIPTICAL EXERCISE APPARATUS

BACKGROUND OF THE INVENTION

1. Field of the Invention

The present invention relates to fitness equipment technology and more particularly, to a lateral glide elliptical exercise apparatus.

2. Description of the Related Art

There is known a lateral glide stationary elliptical exercise machine (WO2014186600), which comprises a frame, a damping means, a pair of pedal means, a pair of gliding guide means and a pair of swing means. The damping means is mounted at the frame, comprising a rotating wheel, a pair of cranks connected to an axle of the rotating wheel, and a damping wheel for providing a damping resistance to the rotating wheel. The pair of pedal means are disposed at two opposite lateral sides relative to the damping means, each comprising a pedal shaft pivotally connected to one respective crank, a pedal pivotally mounted at the pedal shaft, a link pivotally coupled between the pedal shaft and the frame, and a connection bar pivotally connected to the pedal. The damping means provides a damping resistance to the pedal means. The two gliding guide means are respectively mounted at the front side of the frame and extended vertically, each comprising a guide rod and a sliding block connected to the connection bar and slidably coupled to the guide rod.

When the user's legs are stepping on the pedals alternatingly up and down, the front ends of the pedal shafts force the respective links to cause the pedal means to perform a reciprocating motion along an elliptical orbit. At the same time, the sliding blocks are forced by the respective connection bars to reciprocate vertically along the respective guide rods, dragging the respective pedals to swing relative to the respective pedal shafts.

This design of a lateral glide stationary elliptical exercise machine can achieve the expected purposes of fitness, however, due to the gliding guide means extending vertically, when operating the pedal shafts to move the respective connection bars and to further force the respective sliding blocks to move upwardly along the respective guide rods, interferences can occur in the pivoting motion of the pivoting structures between the pedals and the respective sliding blocks and the relative sliding motion between the sliding blocks and the respective guide rods, resulting in an unsmooth operation. Further, the overall structure of this design of lateral glide stationary elliptical exercise machine is complicated.

SUMMARY OF THE INVENTION

The present invention has been developed in view of the above identified circumstances. It is one of the main objects of the present invention to provide a lateral glide elliptical exercise apparatus, which has a simple structure, and facilitates smooth operation.

To achieve this and other objects of the present invention, a lateral glide elliptical exercise apparatus comprises a frame, a damping unit, a pair of pedal units, and a pair of gliding guide units. The frame comprises a front part, a rear part opposite to the front part, and a center line extended from the front part to the rear part. The damping unit is mounted at the frame, and adapted for providing a damping resistance. Further, the damping unit comprises a rotating wheel. The pedal units are respectively disposed at two opposite lateral sides relative to the center line, and adapted for receiving the damping resistance from the damping unit. Each pedal unit comprises a pivoting block for rotating the rotating wheel, and a pedal shaft pivotally connected to the pivoting block. The pedal shaft comprises a front end portion mounted at one side of the pivoting block, and a rear end portion opposite to the front end portion. The gliding guide units are respectively mounted at the frame, each comprising a gliding guide connected to the frame, an actuation block coupled to and movable along the gliding guide and a linkage pivotally coupled between the actuation block and the front end portion of the pedal shaft of the respective pedal unit. The gliding guide comprises an inner end portion, and an opposing outer end portion disposed farther from the center line than the inner end portion. The gliding guide extends along an axis that intersects with the center line. The actuation block is movable by the respective pedal unit to slide along the associated gliding guide between the inner end portion and outer end portion of the associated gliding guide.

The invention has the effects and features as follows:

Subject to the arrangement that the gliding guides of the gliding guide units respectively extend away from the center line in the direction from the respective inner end portions toward the respective outer end portions, the actuation blocks can be driven by the respective pedal units and the respective linkages to slide along the respective gliding guides between the inner end portions and outer end portions of the respective gliding guides, enhancing operational smoothness.

Other advantages and features of the present invention will be fully understood by reference to the following specification in conjunction with the accompanying drawings, in which like reference signs denote like components of structure.

DETAILED DESCRIPTION OF THE INVENTION

Figure 1:
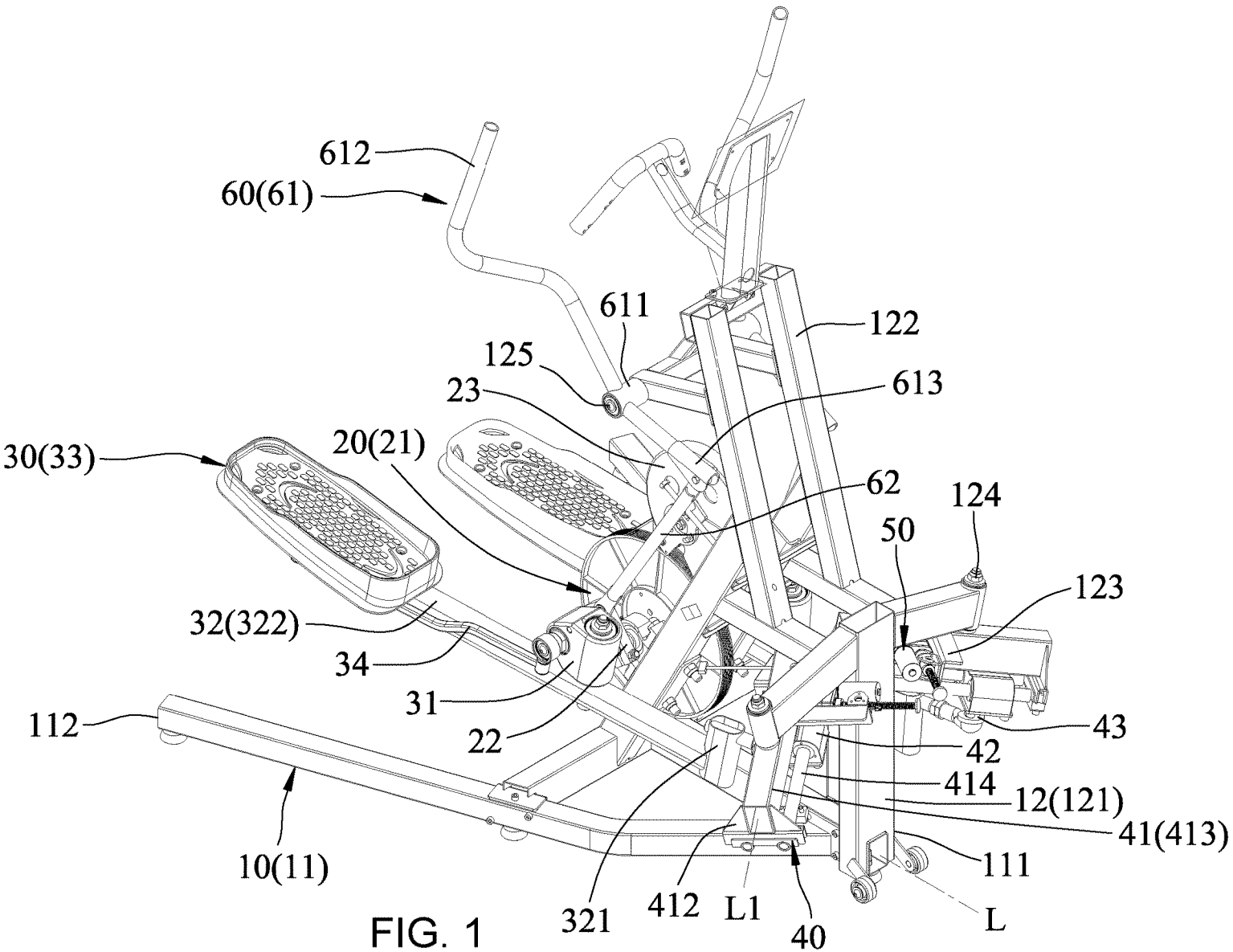
FIG. 1 is an oblique top elevational view of a lateral glide elliptical exercise apparatus in accordance with the present invention.
Figure 2:
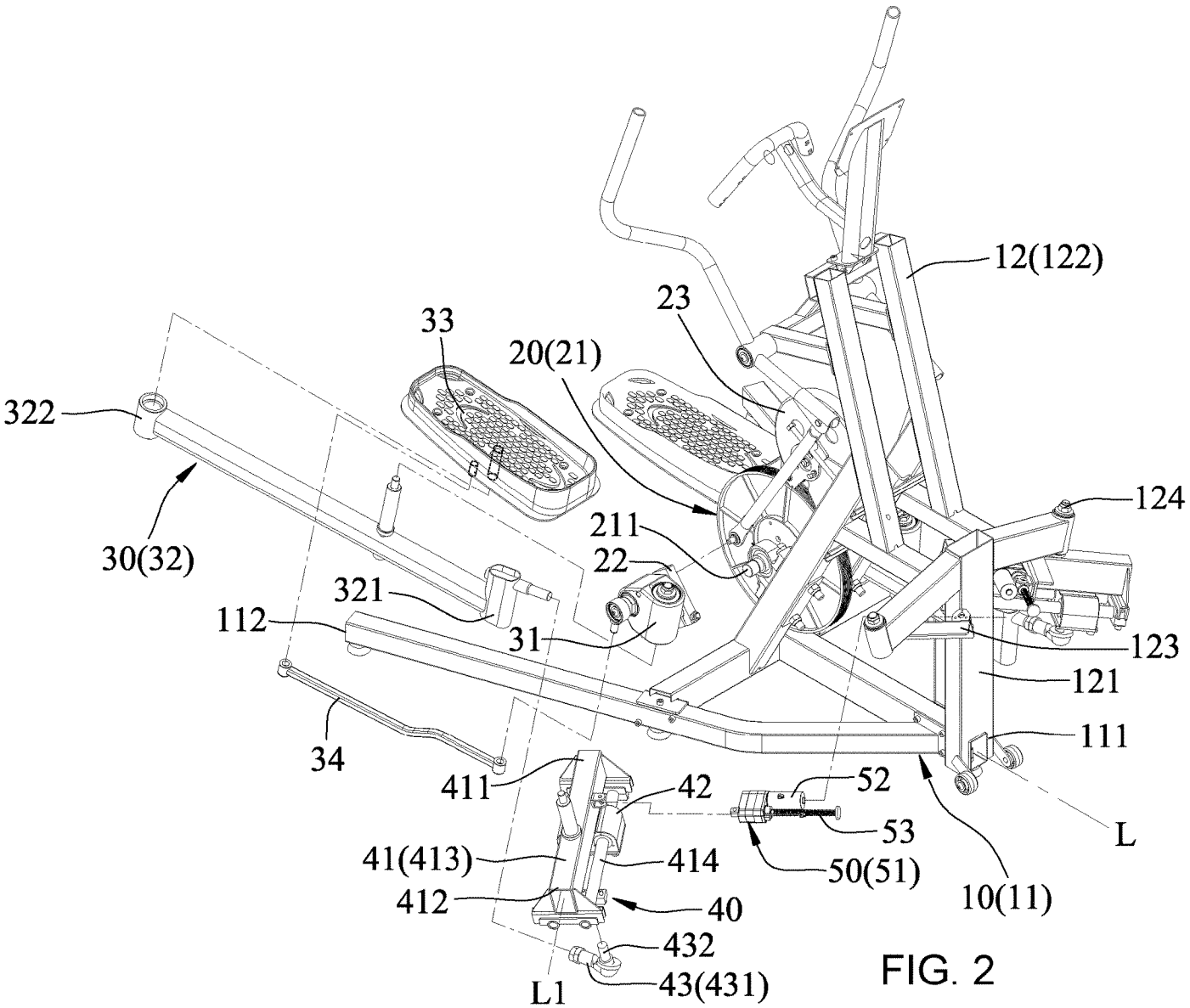
FIG. 2 is a partial exploded view of the lateral glide elliptical exercise apparatus in accordance with the present invention.
Figure 3:
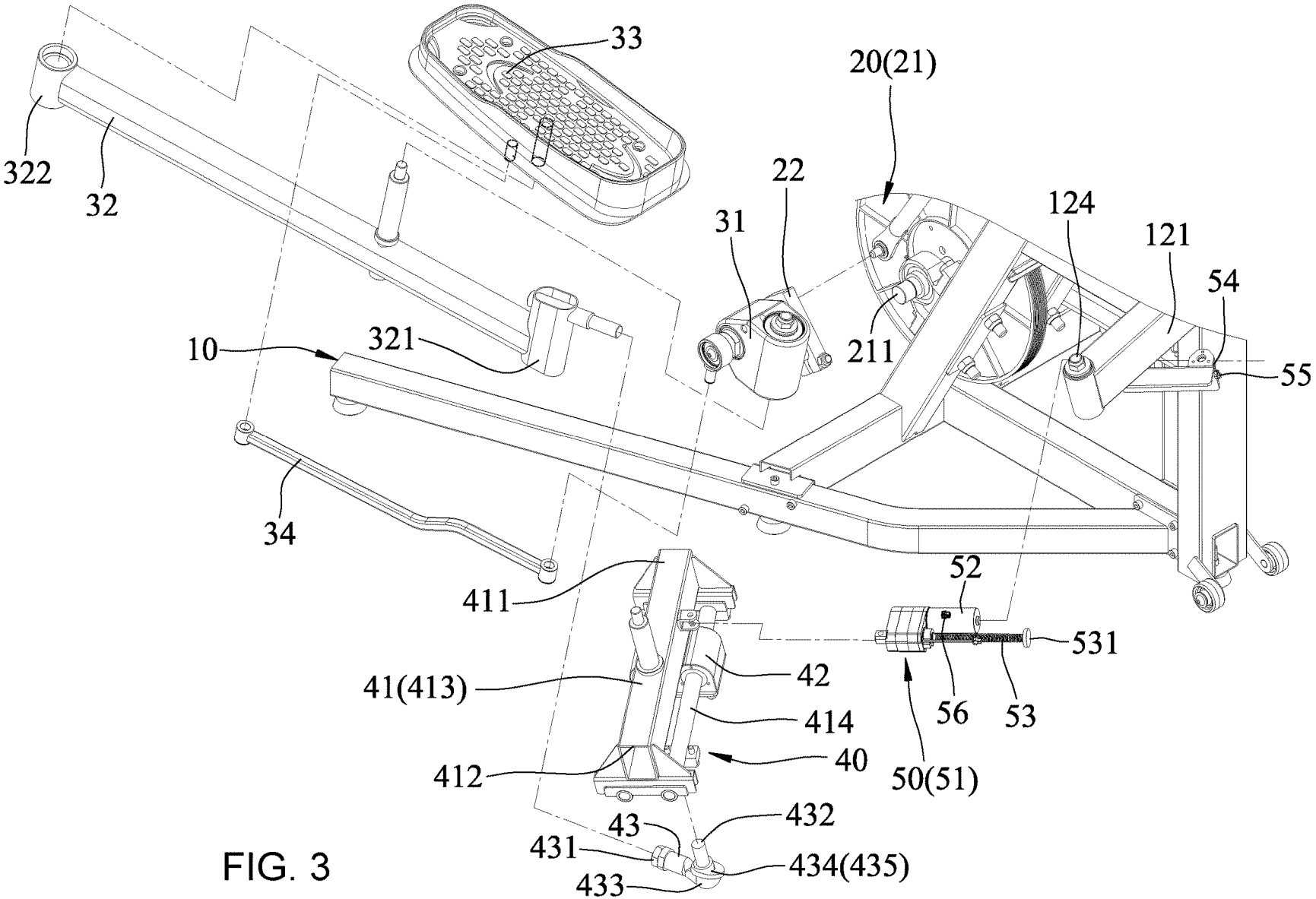
FIG. 3 is another exploded view of a part of the lateral glide elliptical exercise apparatus in accordance with the present invention.
Figure 4:
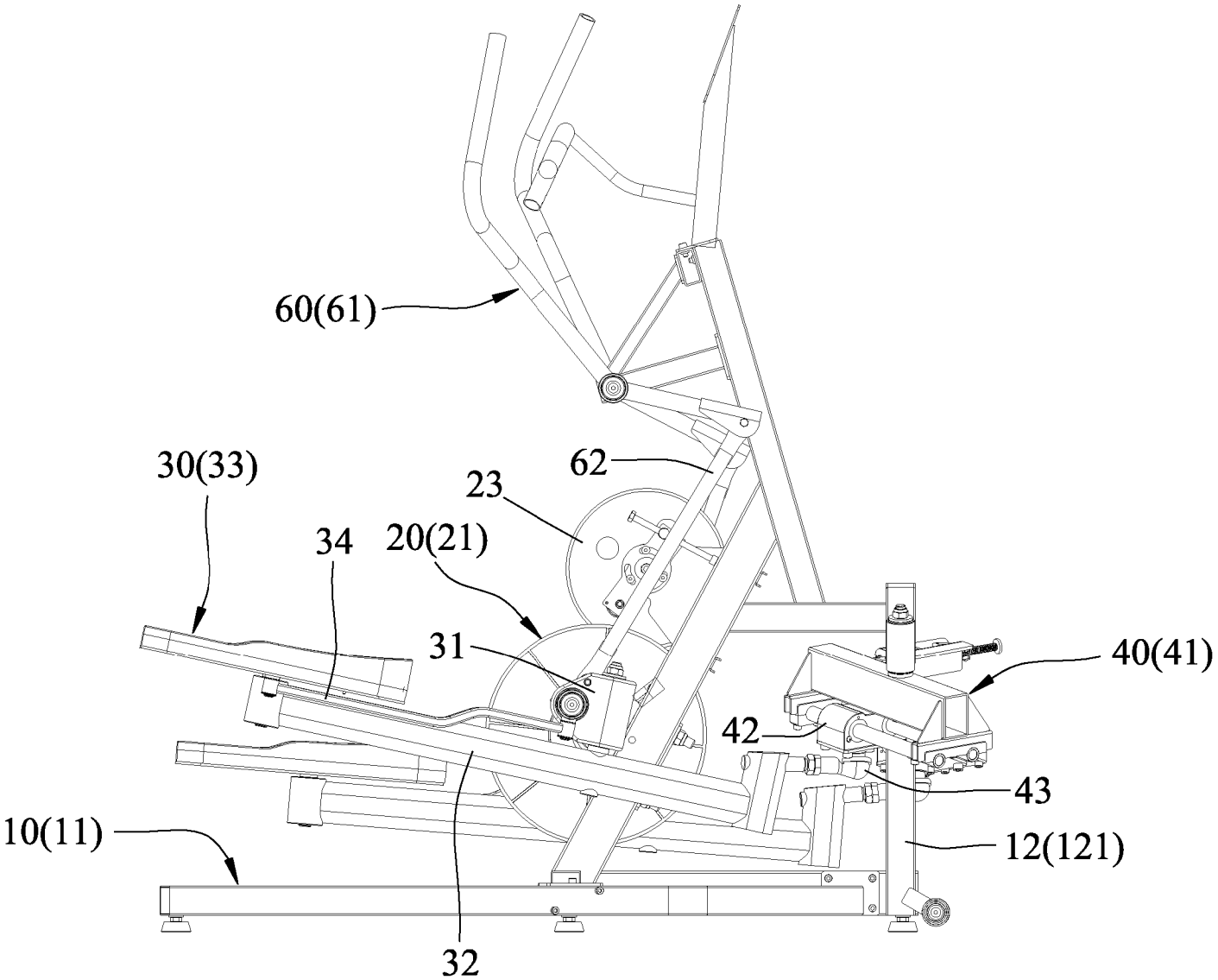
FIG. 4 is a schematic front plain view of the lateral glide elliptical exercise apparatus in accordance with the present invention.

Referring to FIGS. 1, 2, 3 and 4, a lateral glide elliptical exercise apparatus in accordance with the present invention is shown. The lateral glide elliptical exercise apparatus comprises a frame 10, a damping unit 20, a pair of pedal units 30, a pair of gliding guide units 40, a pair of adjustment units 50, and a pair of swing units 60.

The frame 10 comprises a base 11, and an upright support 12 fixedly mounted to the base 11, e.g., via bolts, screws, welding, and the like. The base 11 defines a front part 111, a rear part 112 opposite to the front part 111, and a center line L that extends from the front part 111 towards a rear area near the rear part 112. The upright support 12 comprises a T-shaped front supporting bar 121, a rear rack 122 fixedly connected to a back side of the T-shaped front supporting bar 121, two locating plates 123 respectively that symmetrically extend from the T-shaped front supporting bar 121, two pivot members 124 respectively disposed at an outer side relative to the respective locating plates 123, and a pivot shaft 125 mounted near a top side of the rear rack 122.

The damping unit 20 is mounted in the frame 10, comprising a rotating wheel 21 pivotally mounted to the upright support 12 with a wheel axle 211, a pair of cranks 22 coupled to the wheel axle 211, and a damping wheel 23, an Electro Magnetic System (EMS), mounted to the upright support 12 and adapted for providing a damping resistance to the rotating wheel 21.

The pedal units 30 are disposed at two opposite lateral sides relative to the center line L, each comprising a pivoting block 31 pivotally coupled to one respective crank 22, a pedal shaft 32 pivotally connected to a bottom side of the pivoting block 31, a pedal 33 pivotally connected to pedal shaft 32, and a drag bar 34 pivotally connected between the pedal 33 and the pivoting block 31. The pedal shaft 32 of each pedal unit 30 comprises a front end portion 321 pivotally connected to the associating pivoting block 31 and facing toward the front part 111, and an opposing rear end portion 322 facing toward the rear part 112. The damping unit 20 is capable of providing a damping resistance against the swinging of the pedal units 30.

Figure 6:
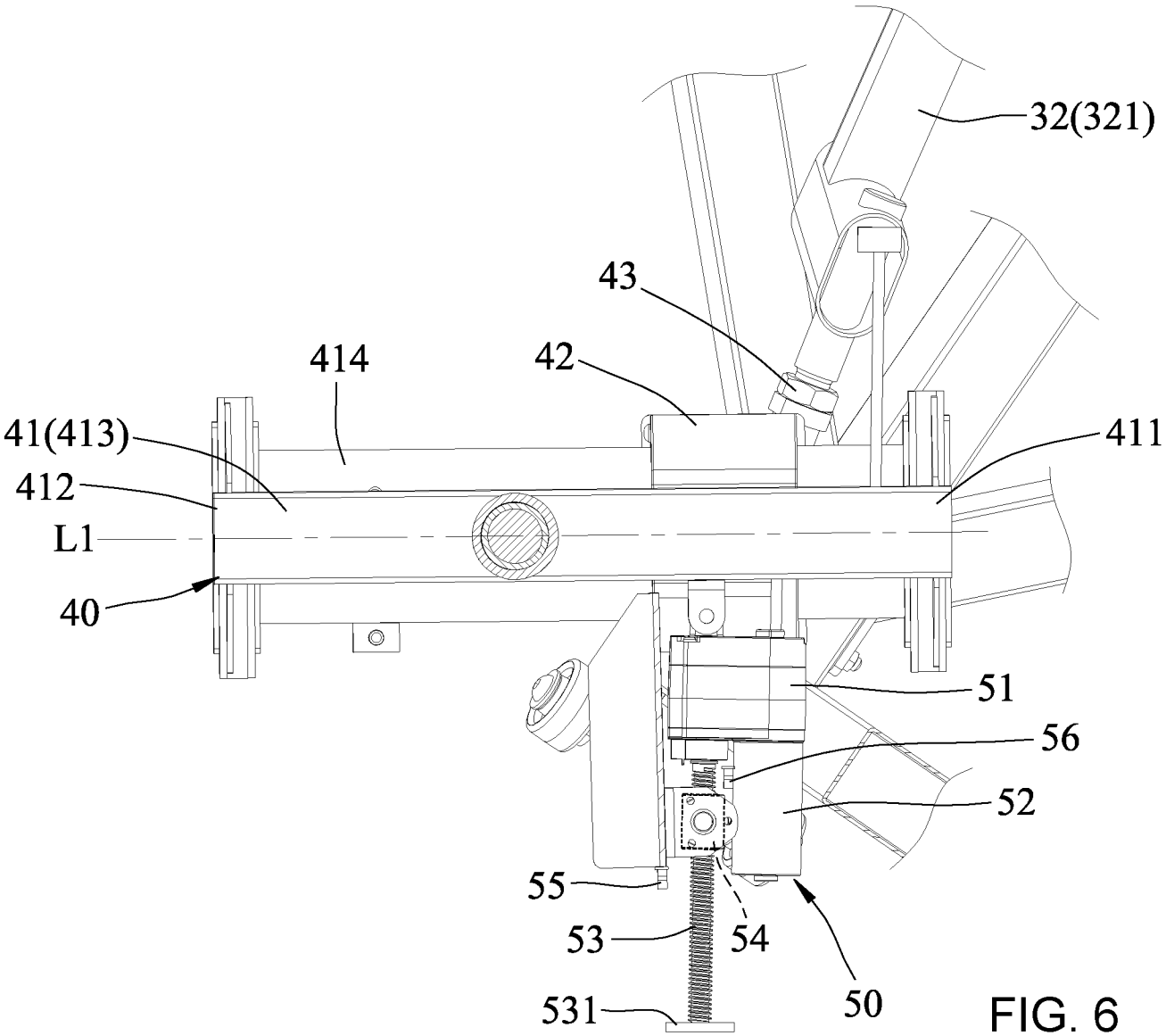
FIG. 6 is a sectional view taken along line VI-VI of FIG. 5.

Referring also to FIG. 6, the gliding guide units 40 are respectively mounted at the front part 111 of the frame 10, each comprising a gliding guide 41 connected to a respective one side of the T-shaped front supporting bar 121, an actuation block 42 linearly slidably mounted in the gliding guide 41, e.g., tongue and groove, wheels, slotted, linear guideway, linear bearings, and the like, and a linkage 43 pivotally coupled between the actuation block 42 and the front end portion 321 of the pedal shaft 32 of the associating pedal unit 30.

Figure 5:
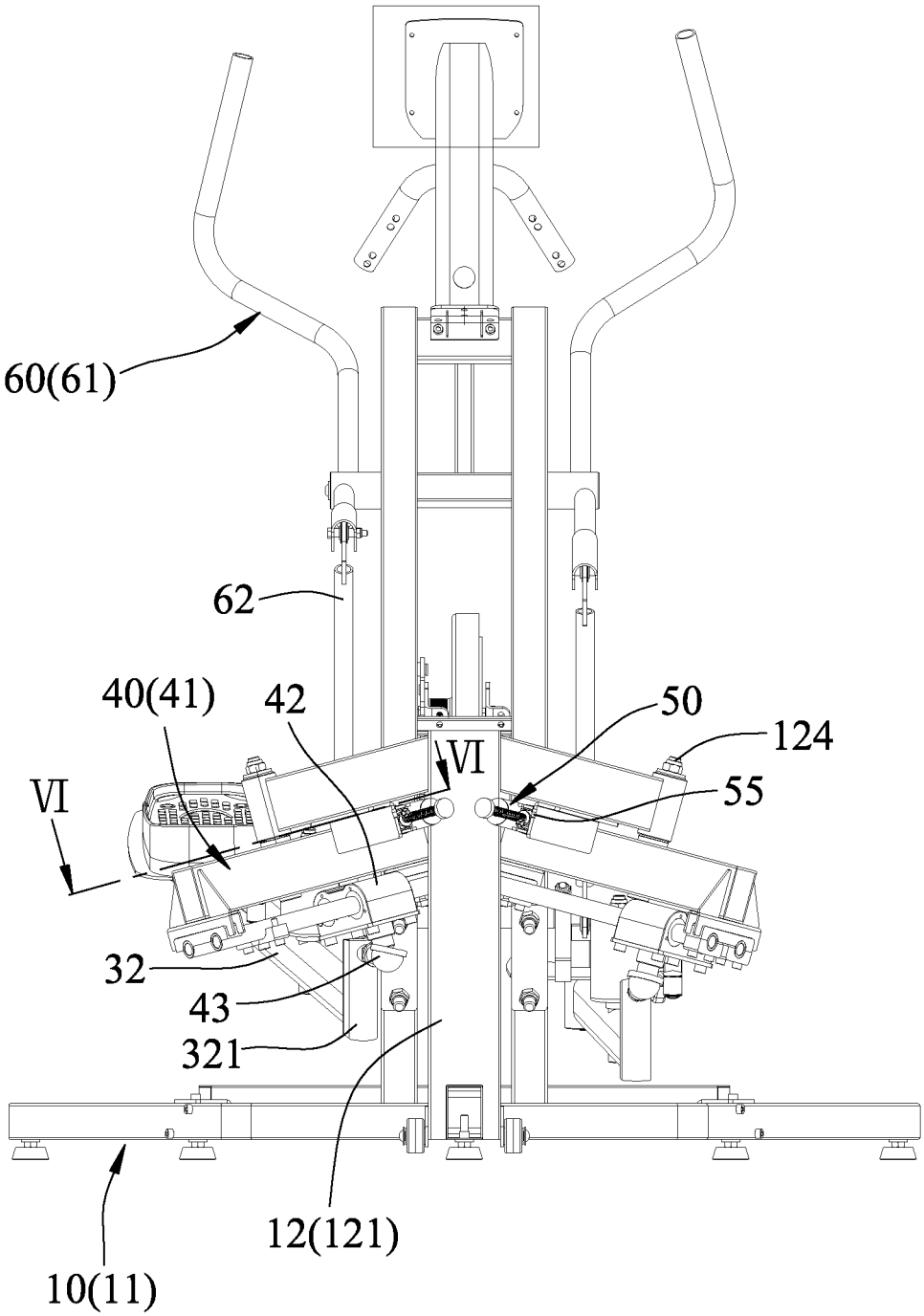
FIG. 5 is a schematic side plain view of the lateral glide elliptical exercise apparatus in accordance with the present invention.

The gliding guides 41 extend along a respective axis L1, each comprising an inner end portion 411, an opposing outer end portion 412 disposed far from the center line L relative to the inner end portion 411, a body block 413 extended from the inner end portion 411 to the outer end portion 412, and a pair of guide rods 414 fixedly mounted at a bottom side of the body block 413. The body blocks 413 of the gliding guides 41 are respectively bilaterally mounted at a bottom side of the T-shaped front supporting bar 121, and respectively pivotally connected to the pivot members 124. Each gliding guide 41 extends from the inner end portion 411 toward the outer end portion 412 gradually far from the center line L in an inclined manner relative to the center line L. Thus, as shown in FIG. 5, the gliding guides 41 are disposed in an inclined position relative to the center line L with the outer end portion 412 held at a relatively lower elevation than the inner end portion 411.

The actuation blocks 42 are respectively slidably coupled to the guide rods 414 of the respective gliding guides 41, and driven by the respective pedal units 30 and the respective linkages 43 to move along the respective guide rods 414 between the inner end portions 411 and outer end portions 412 of the respective gliding guides 41.

The linkage 43 of each gliding guide unit 40 comprises a first link 431 connected to the front end portion 321 of the respective pedal shaft 32, a second link 432 connected to the respective actuation block 42, and an universal joint 433 connected between the first link 431 and the second link 432. The universal joint 433 comprises a socket 434 connected to the first link 431, and a ball 435 connected to the second link 432 and rotatably coupled to the socket 434.

Referring also to FIG. 6, the adjustment units 50 are respectively mounted at the front part 111 of the frame 10, and adapted for respectively adjusting the angle of intersection between the axes L1 of the gliding guide units 40 and the center line L. Each adjustment unit 50 comprises a motor mount 51 pivotally connected to the respective gliding guide 41, a motor 52 mounted at the motor mount 51, a lead screw 53 rotatable by the motor 52, a screw nut 54 threaded onto the lead screw 53 and pivotally connected to a distal end of the respective locating plate 123, a first sensing element 55, such as a limit switch, a photo interrupter or a hall element, facing toward the front part 111 and mounted at the distal end of the respective locating plate 123, and a second sensing element 56, such as a limit switch, a photo interrupter or a hall element, positioned relative to the motor mount 51.

Figure 7:
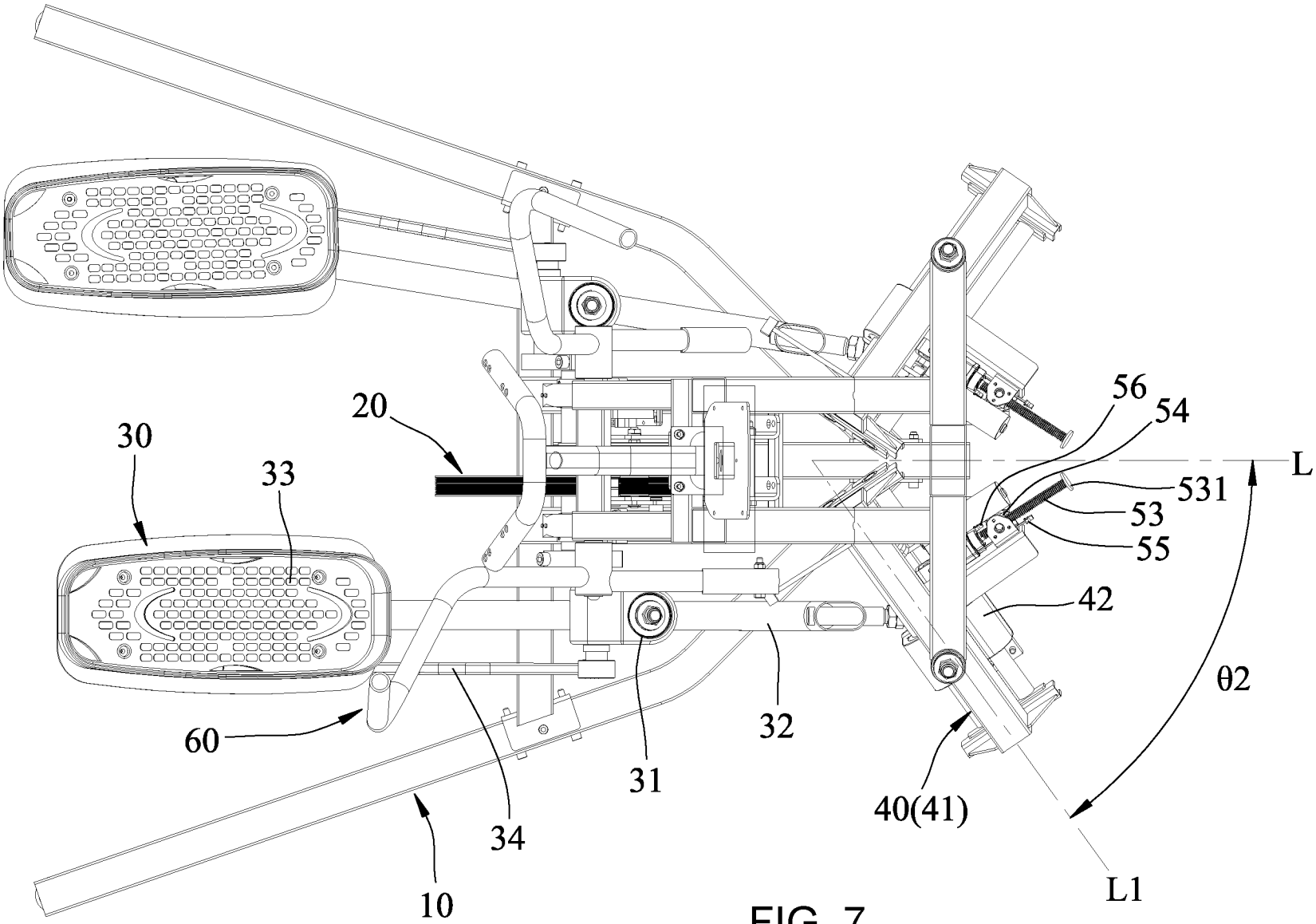
FIG. 7 is a schematic top plain view of the lateral glide elliptical exercise apparatus in accordance with the present invention.

The lead screw 53 of each adjustment unit 50 comprises a stop flange 531 located at one end thereof and facing toward the associating first sensing element 55. Starting up the motor 52 can rotate the respective gliding guide 41 relative to the frame 10 to adjust the angle of intersection between the axis L1 of the respective gliding guide unit 40 and the center line L. The first sensing element 55 is adapted for controlling a creation of a first contained angle θ1 of about 13 degrees (see FIG. 12) between the axis L1 of the respective gliding guide unit 40 and the center line L. The second sensing element 56 is adapted for controlling creation of a second contained angle θ2 of about 56 degrees (see FIG. 7) between the axis L1 of the respective gliding guide unit 40 and the center line L. The second contained angle θ2 is greater than the first contained angle θ1. When the first contained angle θ1 between the axis L1 and the center line L is created, the respective pedal shaft 32 is slightly biased relative to the respective pivoting block 31 (see FIG. 12) through a small angle. When the second contained angle θ2 between the axis L1 and the center line L is created, the respective pedal shaft 32 is biased relative to the respective pivoting block 31 (see FIG. 7) through a relatively larger angle.

The swing units 60 are respectively pivotally mounted at the frame 10, each comprising a swing arm 61 pivotally mounted at the upright support 12 and alternately turnable back and forth relative to the upright support 12, and a linkage rod 62 pivotally connected between the swing arm 61 and the respective pivoting block 31. The swing arm 61 comprises a pivot connecting portion 611, a grip 612 located at one side of the pivot connecting portion 611, and a swinging portion 613 located at an opposite side of the pivot connecting portion 611 opposite to the grip 612. The linkage rod 62 is pivotally connected between the swinging portion 613 and the respective pivoting block 31.

Figure 8:
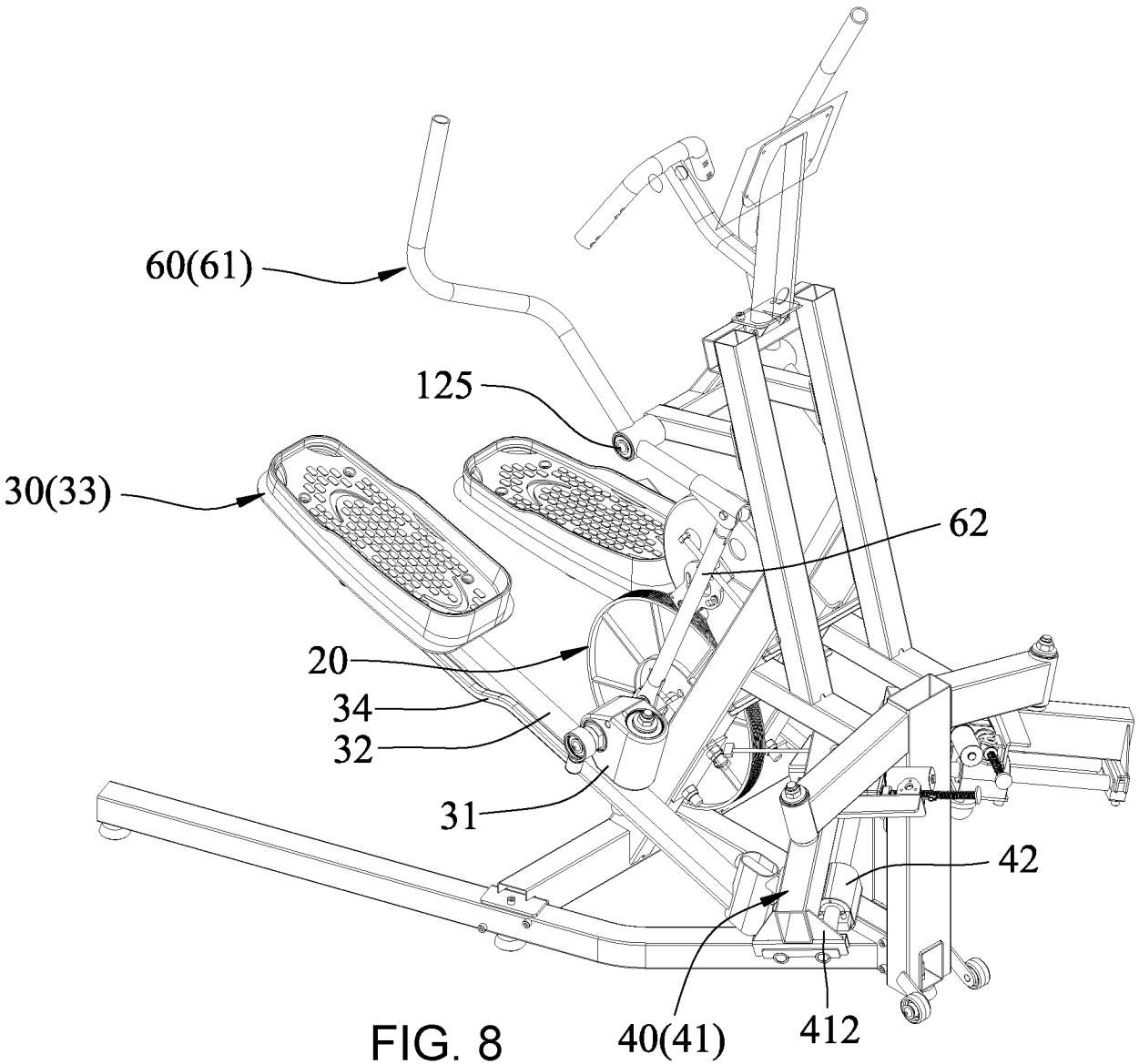
FIG. 8 is similar to FIG. 1, illustrating a status of the lateral glide elliptical exercise apparatus during operation.
Figure 9:
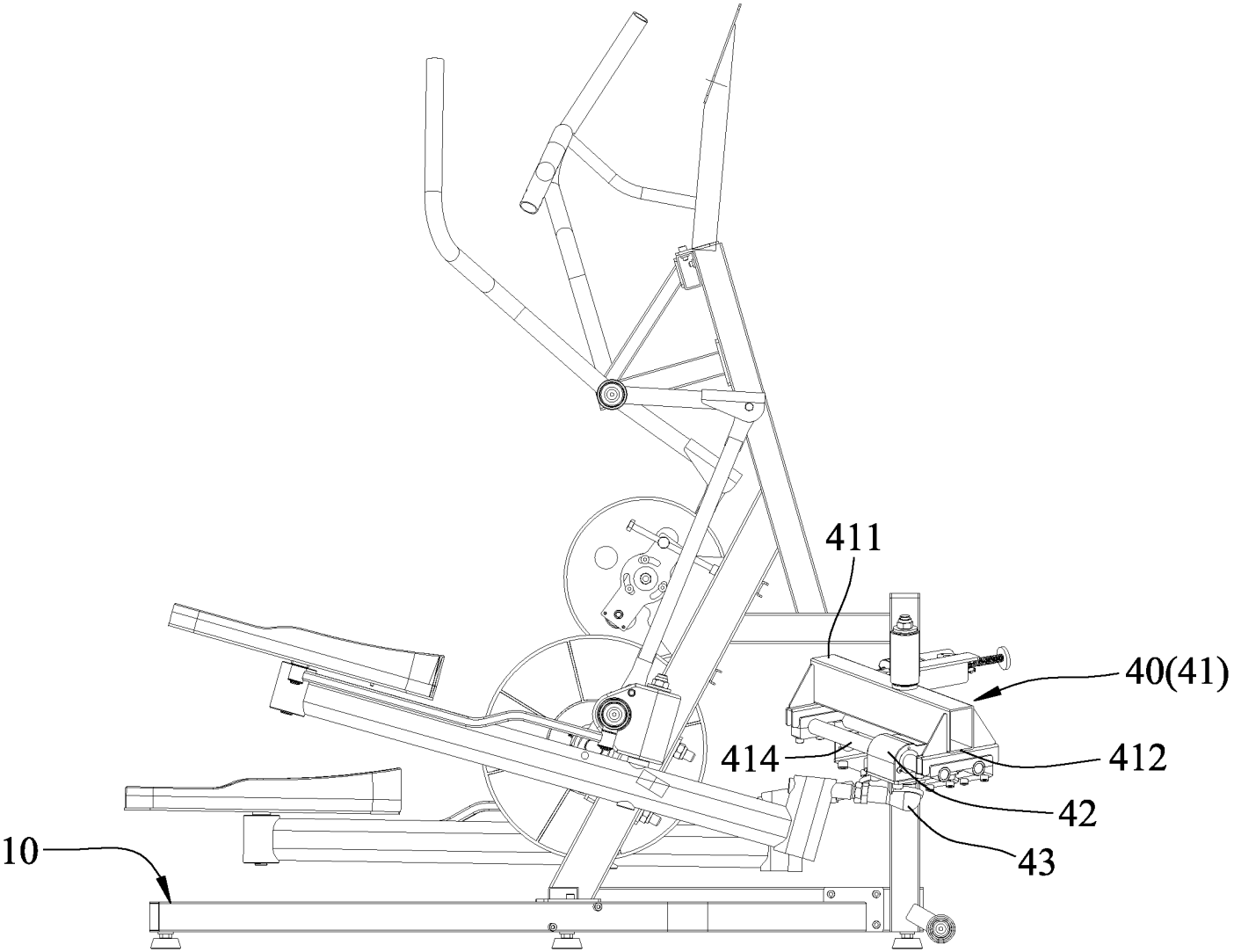
FIG. 9 is similar to FIG. 4, illustrating a status of the lateral glide elliptical exercise apparatus during operation.

Referring to FIGS. 1, 4, 5 and 7, after the lateral glide elliptical exercise apparatus is installed, the user can step on the pedals 3 to operate the lateral glide elliptical exercise apparatus. When the user's legs are stepping on the pedals 33 alternately up and down, the front end portions 321 of the pedal shafts 32 are alternately forced to move the respective linkages 43 and the respective actuation blocks 42, causing the respective actuation blocks 42 to slide forward and backward along the respective guide rods 414 between the respective inner end portions 411 (see FIG. 1 and FIG. 4) and the respective outer end portions 412 (see FIG. 8 and FIG. 9). At this time, subject to the feature that the gliding guides 41 are disposed in an inclined position relative to the center line L with the respective outer end portions 412 held at a relatively lower elevation than the respective inner end portions 411 and the feature that the gliding guides 41 extend gradually outwardly from the center line L in a direction from the respective inner end portions 411 toward the respective outer end portions 412, the front end portions 321 of the pedal shafts 32 are forced to move back and forth toward or away from the center line L. Further, subject to the relatively pivotable relationship between the pedal shafts 32 and the respective pivoting blocks 31, the rear end portions 322 and the pedals 33 are also moved back and forth toward or away from the center line L in a reverse manner. Further, the two pedal units 30 at the two opposite lateral sides relative to the center line L are moved in reversed directions, so there will be no interference, achieving ergonomic comfort. Further, subject to the relative pivoting effect between the pivoting blocks 31 and the respective linking rods 62, the swing arms 61 are turned back and forth about the respective pivot shafts 125 during exercise.

Further, during exercise, the pivotable connection relationship between the pedal shafts 32, the respective pivoting blocks 31 and the respective cranks 22, the damping unit 20 will generate a damping resistance to achieve fitness goals.

Referring to FIGS. 1 and 7 again, when the second contained angle θ2 is created between the axes L1 of the gliding guide units 40 and the center line L, the pedal shafts 32 can be biased relative to the respective pivoting blocks 31 through a relatively larger angle, and the swing amplitude of the user's legs will be larger. At this time, the second sensing elements 56 can touch the respective screw nuts 54 to limit the maximum angle of inclination between the axes L1 of the gliding guide units 40 and the center line L.

Figure 10:
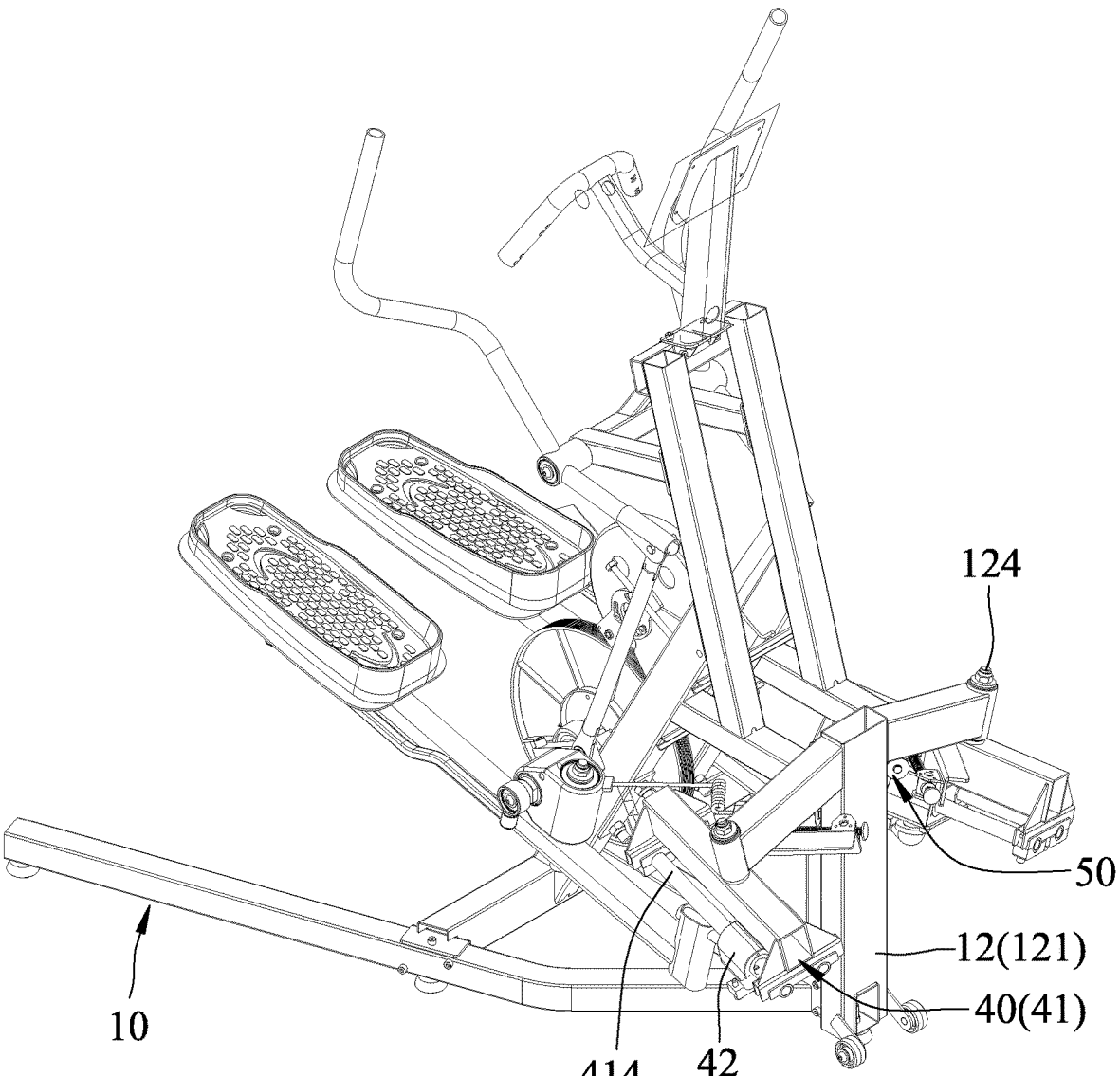
FIG. 10 is an elevational view of the present invention, illustrating an adjustment of the swing amplitude.
Figure 11:
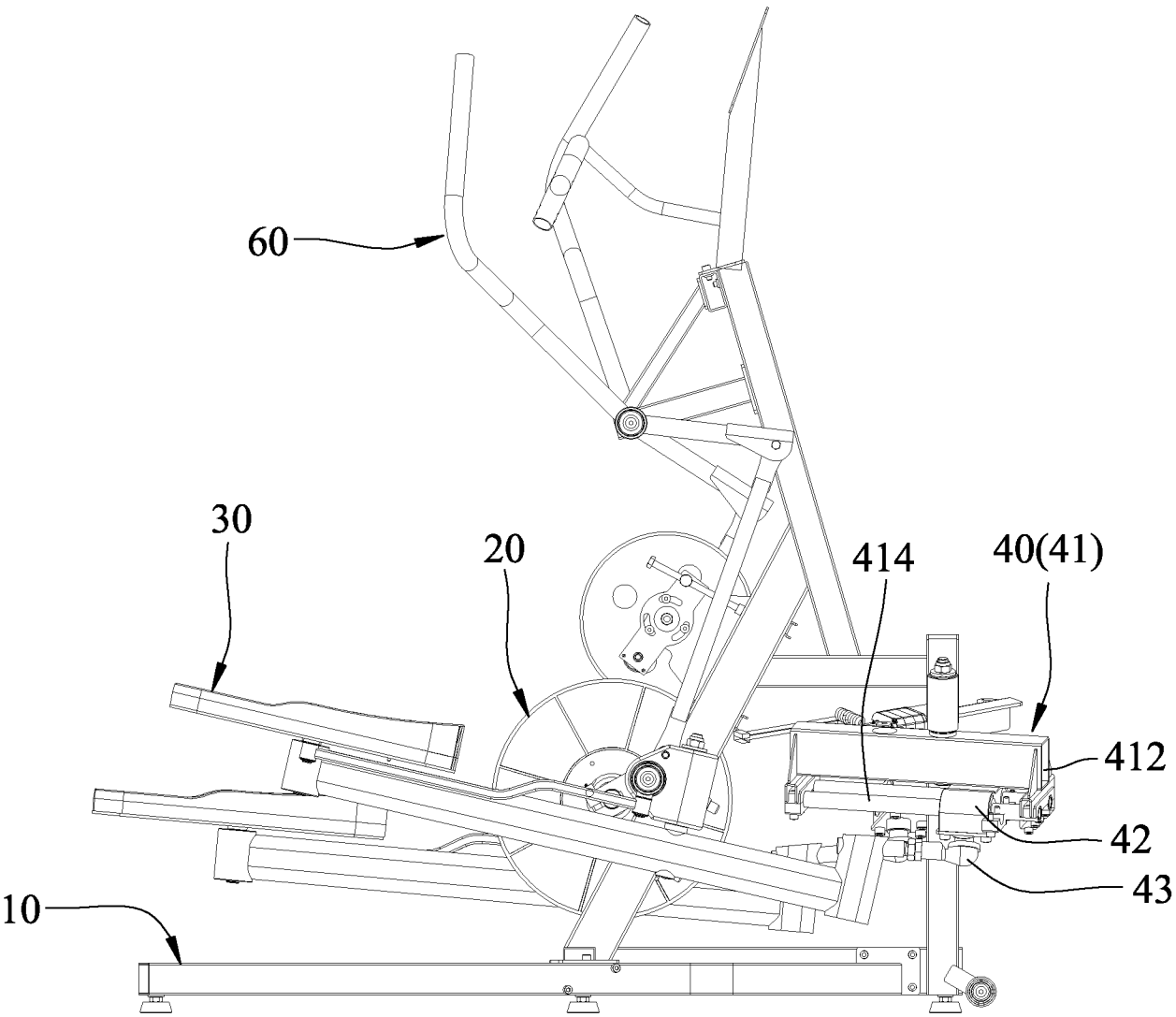
FIG. 11 is a schematic front plain view of the present invention, illustrating an adjustment of the swing amplitude.
Figure 12:
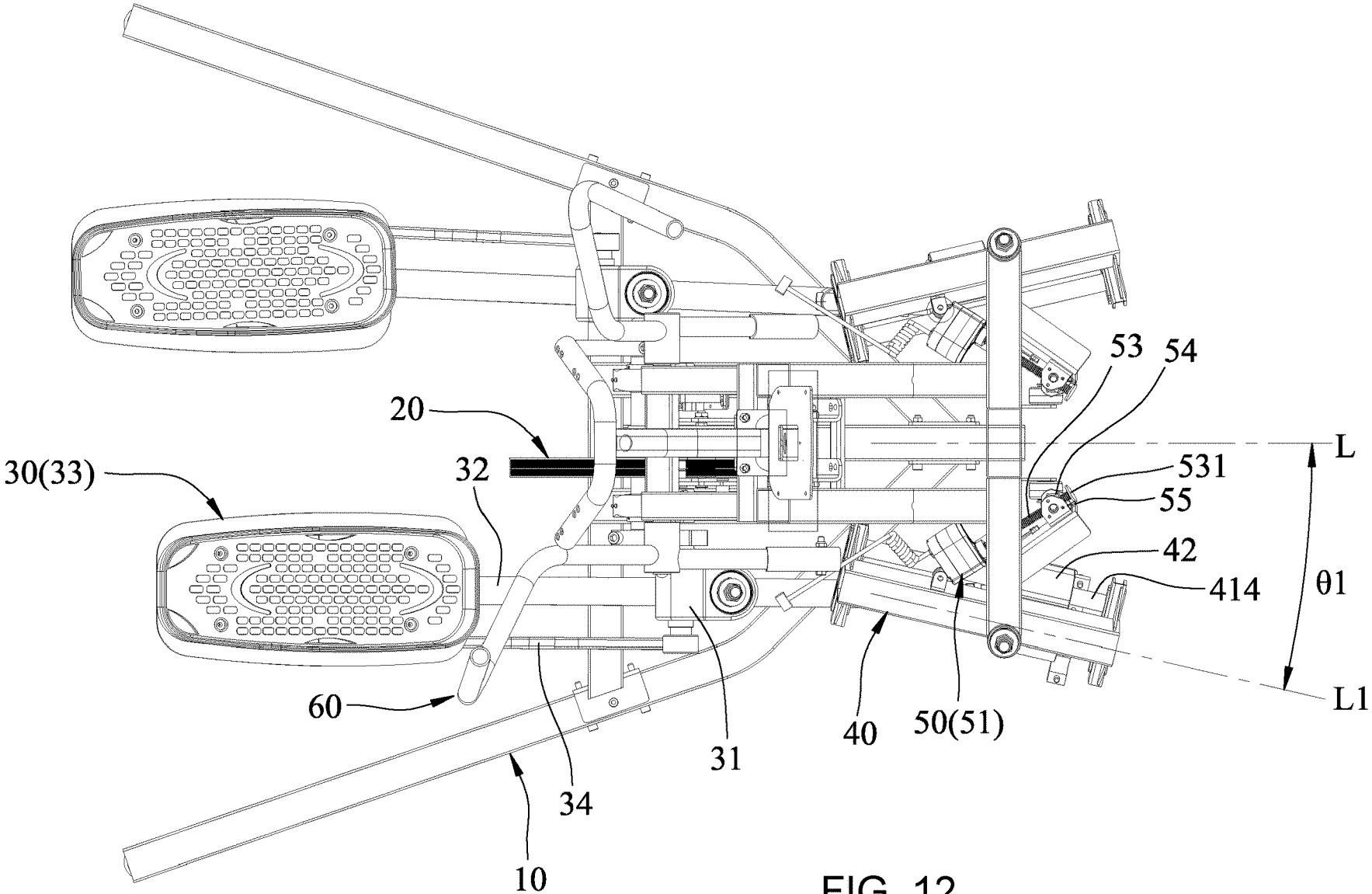
FIG. 12 is a schematic top plain view of the present invention, illustrating an adjustment of the swing amplitude.

Referring to FIGS. 10-12 and FIGS. 2 and 3 again, when the user operates the adjustment units 50 to adjust the angle of intersection between the axes L1 of the gliding guide units 40 and the center line L, the motors 52 are started to rotate the respective lead screws 53 synchronously. Subject to the threaded connection relationship between the lead screws 53 and the respective screw nuts 54 and the pivoting connection relationship between the screw nuts 54 and the respective locating plates 123, starting up the motors 52 can cause the gliding guide units 40 to bias relative to the T-shaped front supporting bar 121, and the angle of intersection between the axes L1 of the gliding guide units 40 and the center line L can be adjusted from the second contained angle θ2 to the first contained angle θ1 till that the stop flanges 531 touch the respective second sensing elements 56. Thus, the invention can limit the minimum angle of inclination between the axes L1 of the gliding guide units 40 and the center line L, avoiding creation of a contained angle between the axes L1 of the gliding guide units 40 and the center line L that is smaller than the first contained angle θ1, and ensuring smooth operation of the pedal units 30.

Figure 13:
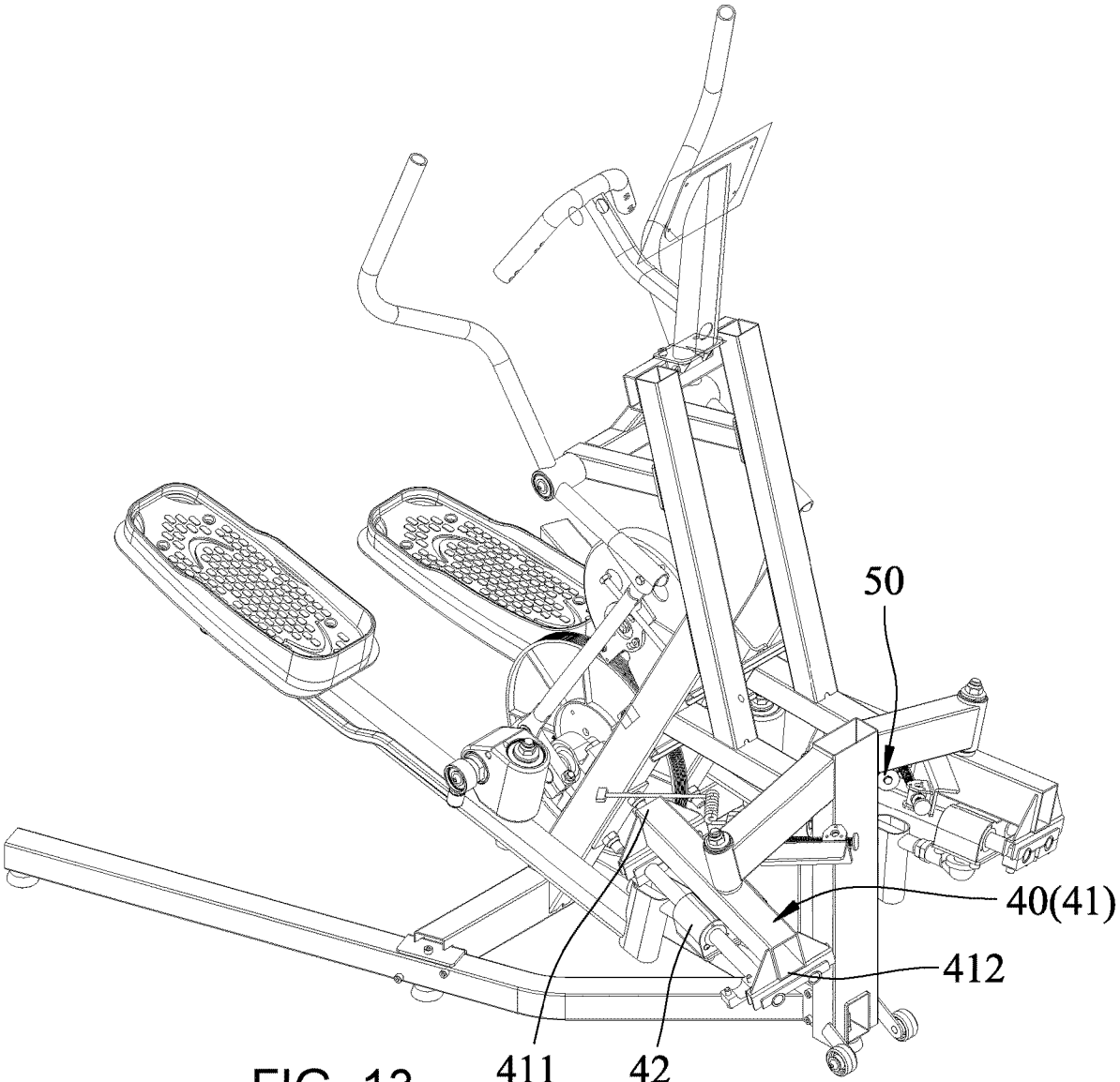
FIG. 13 is similar to FIG. 10, illustrating a status of the lateral glide elliptical exercise apparatus during operation.
Figure 14:
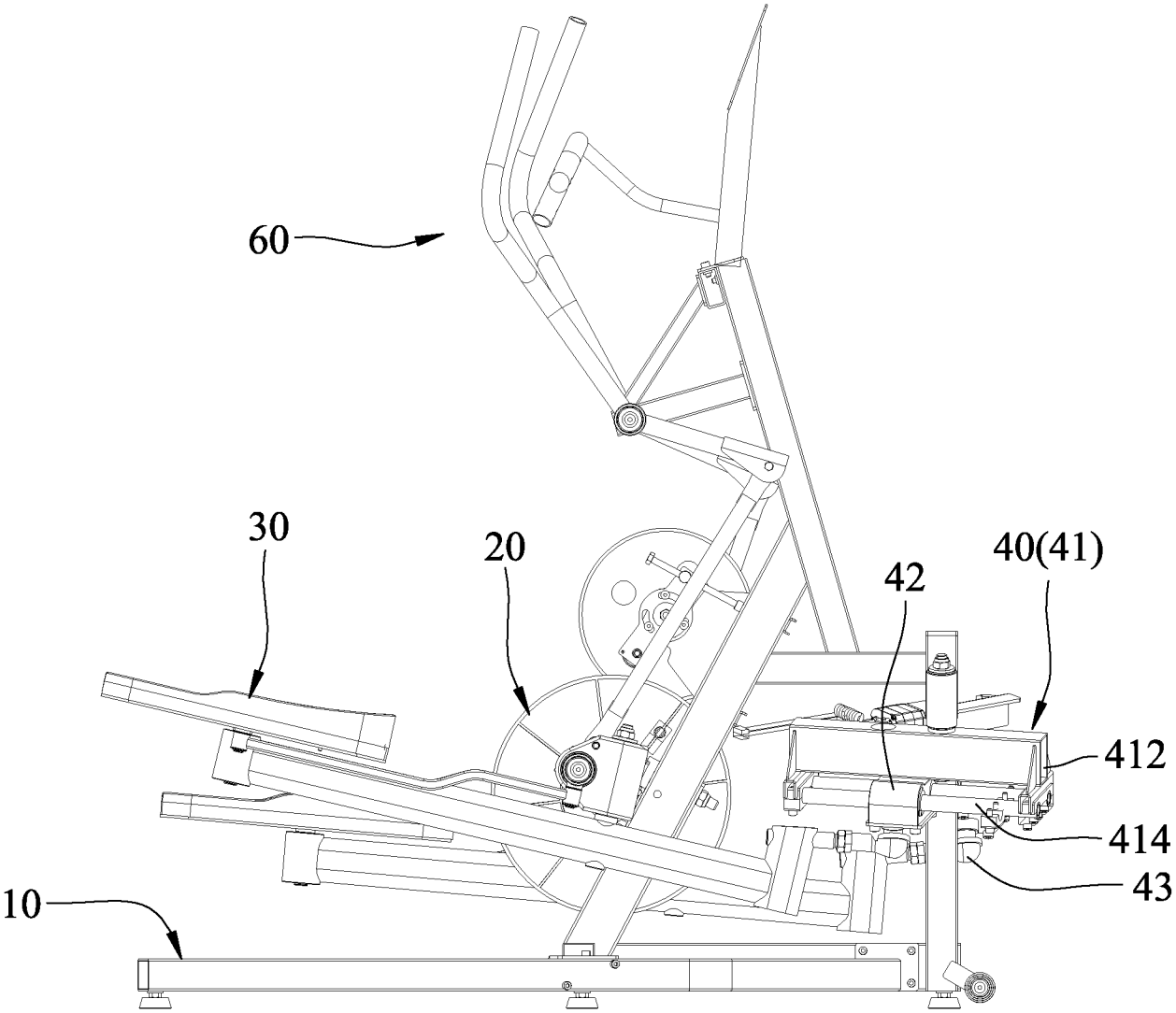
FIG. 14 is similar to FIG. 11, illustrating a status of the lateral glide elliptical exercise apparatus during operation.

Referring to FIGS. 13 and 14 and FIGS. 10 and 11 again, when the user's legs are stepping on the respective pedals 33 alternatingly up and down, the front end portions 321 of the pedal shafts 32 force the respective linkages 43 to move the respective actuation blocks 42 back and forth along the respective guide rods 414 between the respective inner end portions 411 and the respective outer end portions 412 (see FIG. 10 and FIG. 11), and thus, the front end portions 321 of the pedal shafts 32 are respectively moved back and forth toward or away from the center line L. Further, subject to the relatively pivotable relationship between the pedal shafts 32 and the respective pivoting blocks 31, the rear end portions 322 and the pedals 33 are moved back and forth toward or away from the center line L in a reversed manner.

Referring to FIGS. 10, 11, 13 and 14 again, when the first contained angle θ1 is created between the axes L1 of the gliding guide units 40 and the center line L, the pedal shafts 32 can be biased relative to the respective pivoting blocks 31 at a relatively smaller swing amplitude, and the swing amplitude of the user's legs will be relatively smaller.

Thus, subject to the mating arrangement between the gliding guide units 40 and the respective adjustment units 50, the invention achieves stepless adjustment of the amplitude of the pedal units 30. However, it is to be understood that the above description and drawings show only the maximum swing amplitude and the minimum swing amplitude, however, in actual application, the swing amplitude of the pedal units 30 is not limited to the described first and second contained angles θ1,θ2, but can be an angle between the first and second contained angles θ1,θ2.

Additionally, the adjustment units 50 are powered by the motors 52 as electrically adjustable sources, however, in actual application, manual adjustment can be employed, i.e., the motors can be omitted, and the lead screws can be manually rotated to achieve adjustment, e.g., using a handle or twist knob. Further, the invention can be configured to use one single adjustment unit for driving the two gliding guide units. Further, the gliding guides 41 of the gliding guide units 40 are not limited to the configuration disclosed. For example, the gliding guides 41 can be made in the form of a guide rail and mounted at the frame for allowing the respective actuation blocks to slide thereon. Further, in this embodiment, the two opposite ends of each gliding guide are movable. Alternatively, the gliding guides can be configured having a fixed end and an adjustable opposing movable end, achieving the same purpose and effects.

In conclusion, the lateral glide elliptical exercise apparatus of the present invention has the characteristics of a simple structure, ease of lateral gliding operation, and swing amplitude adjustability.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A lateral glide elliptical exercise apparatus, comprising:

a frame comprising a front part, a rear part opposite to said front part, and a center line extended from said front part to an area near said rear part;

a damping unit mounted to said frame and adapted for providing a damping resistance, said damping unit comprising a rotating wheel;

a pair of pedal units respectively disposed at two opposite lateral sides relative to said center line and adapted for receiving said damping resistance from said damping unit, each said pedal unit comprising a pivoting block configured to rotate said rotating wheel and a pedal shaft pivotally connected to said pivoting block, said pedal shaft including a front end portion and a rear end portion opposite to said front end portion, said pivoting block being connected to said pedal shaft between said front end portion and said rear end portion, and each said pedal unit further comprising a pedal pivotally mounted at a respective said pedal shaft, and a drag bar pivotally connected between said pedal and a respective said pivoting block; and a pair of gliding guide units respectively mounted at said frame, each said gliding guide unit comprising a gliding guide connected to said frame, an actuation block coupled to and movable along said gliding guide and a linkage pivotally coupled between said actuation block and said front end portion of said pedal shaft of one respective said pedal unit, said gliding guide comprising an inner end portion and an opposing outer end portion disposed from said center line relative to said inner end portion, said gliding guide extending along an axis that intersects with said center line, said actuation block being movable by one respective said pedal unit to slide along the associated gliding guide between said inner end portion and said outer end portion of the associating said gliding guide.

2. The lateral glide elliptical exercise apparatus as claimed in claim 1, further comprising at least one adjustment unit connected with one of said inner end portion and said outer end portion of said gliding guide of each said gliding guide units, said at least one adjustment unit being mounted with said gliding guide units at said front part of said frame and operable to adjust an angle of intersection between said axis of each said gliding guide and said center line.

3. The lateral glide elliptical exercise apparatus as claimed in claim 2, wherein said gliding guide of each said gliding guide unit further comprises a body block extended from said inner end portion to said outer end portion along said axis thereof and pivotally connected to said frame, and a pair of guide rods located at a bottom side of said body block and biasable by said at least one adjustment unit.

4. The lateral glide elliptical exercise apparatus as claimed in claim 3, wherein the number of said at least one adjustment unit is two, each said adjustment unit comprising a motor mount pivotally connected to one respective said gliding guide, a motor mounted to said motor mount, a lead screw rotatable by said motor and a screw nut threaded onto said lead screw and pivotally connected to said frame for enabling said motor to bias the respective gliding guide relative to said frame to adjust the angle of intersection between the axis of the respective said gliding guide unit and said center line.

5. The lateral glide elliptical exercise apparatus as claimed in claim 4, wherein each said adjustment unit further comprises a first sensing element mounted at said front part of said frame, and a second sensing element positioned relative to the associating said motor mount, said first sensing element being adapted for controlling of a first contained angle between the axis of the respective said gliding guide unit and said center line, said second sensing element being adapted for controlling of a second contained angle between the axis of the respective said gliding guide unit and said center line, said second contained angle being greater than said first contained angle, the creation of said first contained angle between the axis of each said gliding guide unit and said center line allowing the respective pedal shaft to be biased relative to the respective pivoting block at a relatively smaller swing amplitude, the creation of said second contained angle between the axis of each said gliding guide unit and said center line allowing the respective said pedal shaft to be biased relative to the respective said pivoting block at a relatively greater swing amplitude.

6. The lateral glide elliptical exercise apparatus as claimed in claim 1, wherein said linkage of each said gliding guide unit comprises a first link connected to said front end portion of the respective said pedal shaft, a second link connected to the respective said actuation block, and a universal joint connected between said first link and said second link.

7. The lateral glide elliptical exercise apparatus as claimed in claim 6, wherein said universal joint of said linkage of each said gliding guide unit comprises a socket located at one end of said first link, and a ball located at one end of said second link and rotatably coupled to said socket.

8. The lateral glide elliptical exercise apparatus as claimed in claim 1, wherein said frame further comprises a base, and an upright support fixedly mounted at said base corresponding to said front part; the lateral glide elliptical exercise apparatus further comprises a pair of swing units pivotally mounted at said frame, each said swing unit comprising a swing arm pivotally mounted at said upright support and alternately turnable back and forth relative to said upright support and a linkage rod pivotally connected between said swing arm and the respective pivoting block, said swing arm comprising a pivot connecting portion, a grip located at one side of said pivot connecting portion and a swinging portion located at an opposite side of said pivot connecting portion opposite to said grip, said linkage rod being pivotally connected between the associated swinging portion and the respective pivoting block.

9. The lateral glide elliptical exercise apparatus as claimed in claim 1, wherein said damping unit further comprises a wheel axle and a pair of cranks respectively connected to said wheel axle, said wheel axle pivotally connecting said rotating wheel to said frame.

* * * * *